United States Patent [19]

Richeson et al.

[11] Patent Number: 4,872,425

[45] Date of Patent: Oct. 10, 1989

[54] AIR POWERED VALVE ACTUATOR

[75] Inventors: William E. Richeson; Frederick L. Erickson, both of Fort Wayne, Ind.

[73] Assignee: Magnavox Government and Industrial Electronics Company, Fort Wayne, Ind.

[21] Appl. No.: 294,730

[22] Filed: Jan. 6, 1989

[51] Int. Cl.[4] ..... F01L 9/02

[52] U.S. Cl. ..... 123/90.13; 123/90.14; 137/625.64

[58] Field of Search ..... 123/90.11, 90.12, 90.13, 123/90.14; 91/465; 137/625.66, 625.64

[56] References Cited

U.S. PATENT DOCUMENTS

| | | | |
|---|---|---|---|
| 2,552,960 | 5/1951 | Geieshaber et al. | 123/90.14 |
| 3,727,595 | 4/1973 | Links | 123/90.12 |
| 3,738,337 | 6/1973 | Massie | 123/90.12 |
| 4,074,699 | 2/1978 | Stampfli | 137/625.64 |
| 4,257,573 | 3/1981 | Stampfli | 137/625.64 |
| 4,605,197 | 8/1986 | Casey et al. | 137/625.64 |

FOREIGN PATENT DOCUMENTS

| | | | |
|---|---|---|---|
| 2804771 | 8/1978 | Fed. Rep. of Germany | 123/90.14 |

*Primary Examiner*—Charles J. Myhre
*Assistant Examiner*—Weilun Lo
*Attorney, Agent, or Firm*—Roger M. Rickert; Thomas A. Briody; Richard T. Seeger

[57] ABSTRACT

A bistable electronically controlled fluid powered valve actuator for use in an internal combustion engine of the type having engine intake and exhaust valves has a piston reciprocative in a cylinder housing for driving the engine valves to open and close. Control valves are mounted separately from the piston for reciprocative movement in the housing and are used to direct pneumatic pressure to drive the piston. The control valves are magnetically latched in closed positions with magnet force and released after a temporary electromagnetic weakening of the magnetic field. Upon release, the valves are opened pneumatically and closed pneumatically.

24 Claims, 8 Drawing Sheets

AIR POWERED VALVE ACTUATOR

SUMMARY OF THE INVENTION

The present invention relates generally to a two position, straight line motion actuator and more particularly to a fast acting actuator which utilizes pneumatic energy against a piston to perform extremely fast transit times between the two positions. The invention utilizes a pair of control valves to gate high pressure air to the piston and latching magnets to hold the valves in their closed positions until a timed short term electrical energy pulse excites a coil around a magnet to partially neutralize the magnet's holding force and release the associated valve to move in response to high pressure air to an open position. Pressurized pneumatic gases accelerate the piston rapidly from one position to the other position.

This actuator finds particular utility in opening and closing the gas exchange, i.e., intake or exhaust, valves of an otherwise conventional internal combustion engine. Due to its fast acting trait, the valves may be moved between full open and full closed positions almost immediately rather than gradually as is characteristic of cam actuated valves.

The actuator mechanism may find numerous other applications such as in compressor valving and valving in other hydraulic or pneumatic devices, or as a fast acting control valve for fluidic actuators or mechanical actuators where fast controlled action is required such as moving items in a production line environment.

Internal combustion engine valves are almost universally of a poppet type which are spring loaded toward a valve-closed position and opened against that spring bias by a cam on a rotating cam shaft with the cam shaft being synchronized with the engine crankshaft to achieve opening and closing at fixed preferred times in the engine cycle. This fixed timing is a compromise between the timing best suited for high engine speed and the timing best suited to lower speeds or engine idling speed.

The prior art has recognized numerous advantages which might be achieved by replacing such cam actuated valve arrangements with other types of valve opening mechanism which could be controlled in their opening and closing as a function of engine speed as well as engine crankshaft angular position or other engine parameters.

In copending application Ser. No. 021,195 entitled ELECTROMAGNETIC VALVE ACTUATOR, filed Mar. 3, 1987 in the name of William E. Richeson and assigned to the assignee of the present application, there is disclosed a valve actuator which has permanent magnet latching at the open and closed positions. Electromagnetic replusion may be employed to cause the valve to move from one position to the other. Several damping and energy recovery schemes are also included.

In copending application Ser. No. 153,257 entitled PNEUMATIC ELECTRONIC VALVE ACTUATOR, filed Feb. 8, 1988 in the names of William E. Richeson and Frederick L. Erickson there is disclosed a somewhat similar valve actuating device which employs a release type mechanism rather than a repulsion scheme as in the previously identified copending application. The disclosed device in this application is a truly pneumatically powered valve with high pressure air supply and control valving to use the air for both damping and as the primary motive force. This copending application also discloses different operating modes including delayed intake valve closure and a six stroke cycle mode of operation.

Other related applications all assigned to the assignee of the present invention and filed in the name of William E. Richeson on Feb. 8, 1988 are Ser. No. 153,262, POTENTIAL-MAGNETIC ENERGY DRIVEN VALVE MECHANISM where energy is stored from one valve motion to power the next, and Ser. No. 153,154, filed on Feb. 8, 1988 REPULSION ACTUATED POTENTIAL ENERGY DRIVEN VALVE MECHANISM wherein a spring (or pneumatic equivalent) functions both as a damping device and as an energy storage device ready to supply part of the accelerating force to aid the next transition from one position to the other. One distinguishing feature of the REPULSION ACTUATED POTENTIAL ENERGY DRIVEN VALVE MECHANISM application is the fact that initial accelerating force is partly due to electromagnetic repulsion somewhat like that employed in the first above mentioned copending application.

In copending application Ser. No. 153,155 filed Feb. 8, 1988, in the names of William E. Richeson and Frederick L. Erickson, assigned to the assignee of the present application and entitled PNEUMATICALLY POWERED VALVE ACTUATOR, there is disclosed a valve actuating device generally similar in overall operation to the present invention. One feature of this application is that control valves and latching plates have been separated from the primary working piston to provide both lower latching forces and reduced mass resulting in faster operating speeds. This concept is incorporated in the present invention and it is one object of the present invention to further improve these two aspects of operation.

In Applicants' Ser. No. 294728 filed 1-6-89 filed in the names of Richeson and Erickson on even date herewith and entitled ENHANCED EFFICIENCY VALVE ACTUATOR, there is a disclosure of a pneumatically powered valve actuator which has a pair of control valves with permanent magnet latching of these valves in a closed position. The magnetic latching force (and thus the size/cost/power of the latching and release components) is reduced by a recapture and use of kinetic energy of the main piston to reclose the control valves. The main piston shaft has o-ring carrying members at each end to drive the air control valve closed should it fail to close otherwise, also a sealed chamber is formed at the end of valve travel as the valves near their respective open positions. Air is compressed in the chambers to act as an air spring to aid in reclosing the valves, again reducing the latching and release components size/cost/power.

In Applicants' assignee Ser. No. 295177 filed 1-6-89 filed in the names of Richeson and Erickson on even date herewith and entitled FAST ACTING VALVE there is disclosed a valve actuating mechanism having a pair of auxiliary pistons which aid in reclosing air control valves while at the same time damping main piston motion near the end of the mechanism travel.

In Applicants' Ser. No. 294727 filed 1-6-89 filed in the names of Richeson and Erickson on even date herewith and entitled PNEUMATIC ACTUATOR, an actuator has one-way pressure relief valves similar to the relief valves in the above mentioned Ser. No. 209,279 to vent captured air back to the high pressure source. The actuator also has 'windows' or venting valve undercuts in the main piston shaft which are of reduced size as compared to the windows in other of the cases filed on even date herewith resulting in a higher compression ratio. The actuator of this application increases the area which is pressurized when the air control valve closes thereby still further reducing the magnetic force required.

In Applicants' Ser. No. 294729 filed 1-6-89 filed in the name of William E. Richeson on even date herewith and entitled ELECTRO-PNEUMATIC ACTUATOR, an actuator which reduces the air demand on the high pressure air source by recovering as much as possible on the air which is compressed during damping. The main piston provides a portion of the magnetic circuit which holds the air control valves closed. When a control valve is opened, the control valve and the main piston both move and the reluctance of the magnetic circuit increases dramatically and the magnetic force on the control valve is correspondingly reduced.

In Applicants' Ser. No. 295178 filed 1-6-89 filed in the names of Richeson and Erickson on even date herewith and entitled COMPACT VALVE ACTUATOR, the valve actuator cover provides a simplified air return path for low pressure air and a variety of new air venting paths allow use of much larger high pressure air accumulators close to the working piston.

All of the above noted cases filed on even date herewith have a main or working piston which drives the engine valve and which is, in turn powered by compressed air. The power or working piston is separated from the latching components and certain control valving structures so that the mass to be moved is materially reduced allowing very rapid operation. Latching and release forces are also reduced. Those valving components which have been separated from the main piston need not travel the full length of the piston stroke, leading to some improvement in efficiency. Compressed air is supplied to the working piston by a pair of control valves with that compressed air driving the piston from one position to another as well as typically holding the piston in a given position until a control valve is again actuated. The control valves are held closed by permanent magnets and opened by an electrical pulse in a coil near the permanent magnet. All of the cases employ 'windows' which are cupped out or recessed regions on the order of 0.1 inches in depth along a somewhat enlarged portion of the shaft of the main piston, for passing air from one region or chamber to another or to a low pressure air outlet. These cases may also employ a slot centrally located within the piston cylinder for supplying an intermediate latching air pressure as in the above noted Ser. No. 153,155 and a reed valve arrangement for returning air compressed during piston damping to the high pressure air source as in the above noted Ser. No. 209,279.

The entire disclosures of all of the above identified copending applications are specifically incorporated herein by reference.

In the present invention, the power or working piston which moves the engine valve between open and closed positions is separated from the latching components and certain control valving structures so that the mass to be moved is materially reduced allowing much faster operation as explained in Ser. No. 153,155. Latching and release forces are reduced by providing positive pneumatic pressure differentials across opposite sides of the control valve so that the primary closing force of the control valve is provided by pneumatic force instead of the magnetic force of the piston. The piston body has several air passing bores extending in its direction of reciprocation for providing an effective and efficient source of low or atmospheric air pressure at the opposite ends of the piston.

Among the several objects of the present invention may be noted the provision of a bistable fluid powered actuating device characterized by extremely fast transition times and economy of size, manufacture and power requirements; the provision of a pneumatically powered valve actuator where the control valves within the actuator cooperate with, but operate separately from the main working piston and are urged to a latched or closed position through a positive pneumatic pressure differential on opposite sides of the control valve during latching or closing whereby the latching magnets are reduced in size and cost and required power to operate the valve. Further, porting is simplified by providing axially parallel bores through the piston body to provide conveniently and efficiently a source of low or atmospheric pressure at each control valve to provide the desired pressure differentials to close the valves. Further, a portion of one valve surface is constantly subject to the pneumatic pressure source throughout the valve cycle to provide controlled valve movement throughout the cycle. These as well as other objects and advantageous features of the present invention will be in part apparent and in part pointed out hereinafter.

In general, a bistable electronically controlled fluid powered transducer has an air powered piston which is reciprocable along an axis between first and second positions along with a control valve reciprocable along the same axis between open and closed positions. A magnetic latching arrangement functions to hold or latch the control valve in the closed position while an electromagnetic arrangement may be energized to temporarily weaken the effect of the permanent magnet latching arrangement to release the control valve to move from the closed position to the open position under pneumatic force. Energization of the electromagnetic arrangement causes movement of the control valve in one direction along the axis allowing fluid from a high pressure source to drive the piston in the opposite direction from the first position to the second position along the axis. The distance between the first and second positions of the piston is typically greater than the distance between the open and closed positions of the valve.

Also in general and in one form of the invention, a pneumatically powered valve actuator includes a valve actuator housing with a piston reciprocable inside the housing along an axis. The piston has a pair of oppositely facing primary working surfaces.

A pair of air control valves are reciprocative along the same axis between open and closed positions. A coil formed about a latching permanent magnet is pulsed to temporarily weaken the permanent magnet thus unlatching its respective air control valve. The control valve has one surface subject to a fluid pressure to move the valve toward its open position. Movement of the control valve after unlatching introduces fluid pressure to a primary working surface of the piston to move the piston toward its second position. Movement of the piston, in turn, introduces fluid pressure to a control valve surface opposite to the one surface to provide a net closing force across the control valve and significantly reduce the force required by the permanent magnet to reclose the control valve and thus the size and cost of the latching permanent magnet and the neutralizing coil, and the power required by the coil.

Another feature of this invention is the provision of equalization air passages in the form of bores through the piston body which provide a constant low or atmospheric pressure to chambers at each end of the piston body. The chambers are formed in part by the inner surfaces of the control valves. During the piston cycle between its first and second positions, at least one of the chambers is in communication with the low or atmospheric pressure and since the equalization passages provide constant fluid communication between the chambers, boh chambers and their respective valve surfaces are provided constantly with low pressure which facilitates valve closing under pneumatic pressure.

Also disclosed in this application and as more fully disclosed in the above referenced copending application Ser. No. 153,155, there is an air vent located about midway between the extreme positions of piston reciprocation for dumping expanded air from the one primary working surface and removing the accelerating force from the piston. The air vent also functions to introduce air at an intermediate pressure to be captured and compressed by the opposite primary working surface of the piston to allow piston motion as it nears one of the extreme positions and the air vent supplies intermediate pressure air to one primary working surface of the piston to temporarily hold the piston in one of its extreme positions pending the next opening of an air control valve. The air control valve is uniquely effective to vent air from the piston for but a short time interval after damping near the end of a piston stroke while supplying air to power the piston during a much longer time interval earlier in the stroke.

BRIEF DESCRIPTIN OF THE DRAWINGS

Corresponding reference characters indicate corresponding parts throughout the several views of the drawing.

Figure 1:
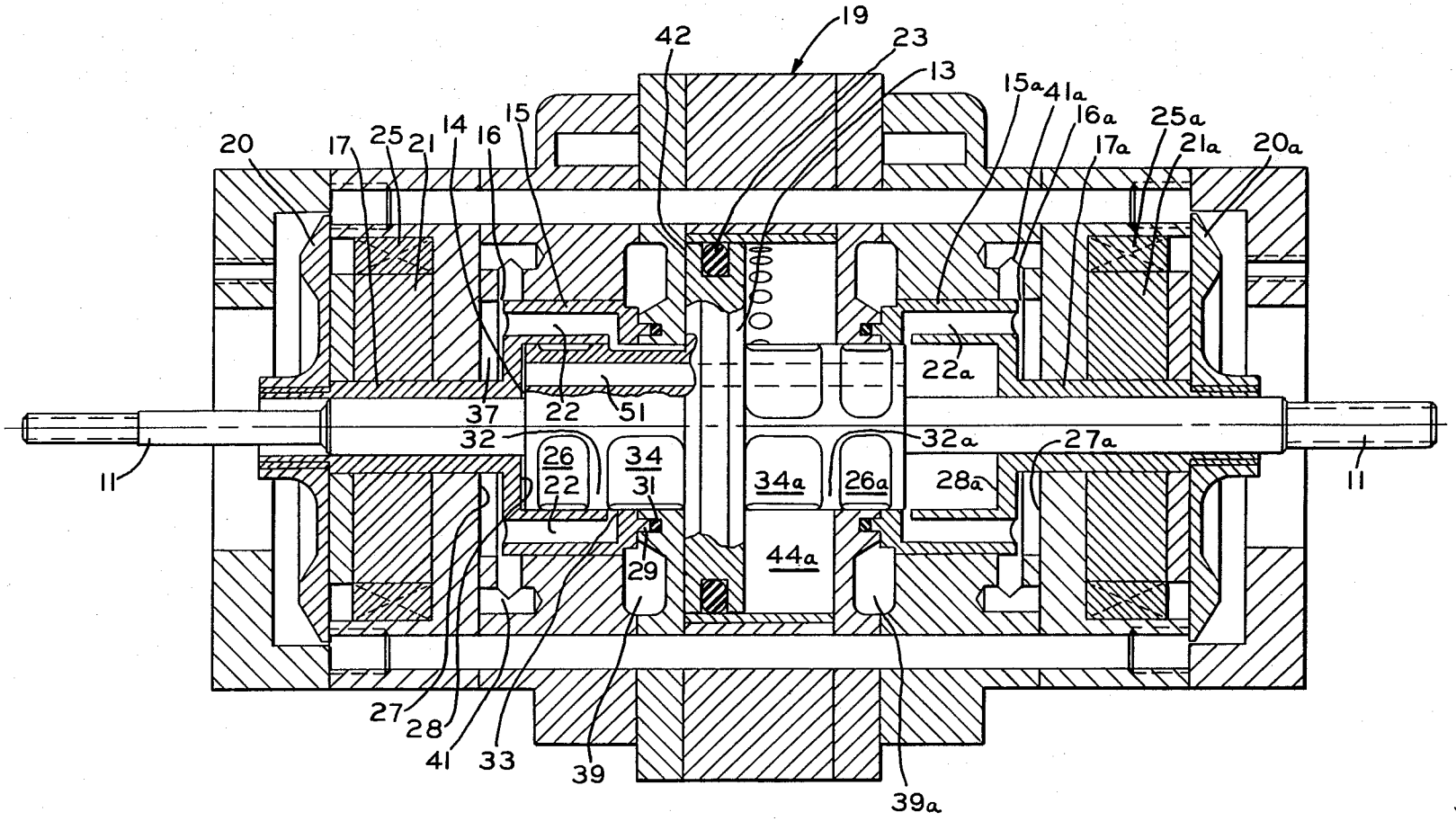
FIG. 1 is a view in cross-section showing the pneumatically powered actuator of the present invention with the power piston latched in its leftmost position as it would normally be when the corresponding engine valve is closed.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

The valve actuator is illustrated sequentially in FIGS. 1–7 to illustrate various component locations and functions in moving a poppet valve or other component (not shown) from a closed to an open position. Motion in the opposite direction although not described will be clearly understood from the symmetry of the components. Symmetrical components on the right side of the FIGURES are assigned the same reference numeral as corresponding components on the left side, with the exception that the reference numerals have the suffix 'a.' The actuator includes a shaft or stem 11 which may at one end form a part of or connect to an internal combustion engine poppet valve. The actuator also includes a low mass reciprocable piston 13 carrying an o-ring 23, and a pair of reciprocating or sliding control valve members 15 and **15*a* enclosed within a housing 19. The control valve members 15 and 15*a* are latched in one position by permanent magnets 21 and 21*a* respectively and may be dislodged from their respective latched positions by pulse energization of coils 25 and 25*a* respectively from a pulse source not shown but synchronized with piston movement. Valves 15, 15*a* each comprise annular bodies having elongated tubular shafts, 17, 17*a* respectively. The permanent magnet latching arrangement also includes iron pole pieces or armatures 20 and 20*a*. The control valve members or shuttle valves 15 and 15*a* cooperate with both the piston 13 and the housing 19 to achieve the various porting functions during operation. The housing 19 has high pressure annular cavities 39, 39*a* fed by pump, not shown, and low pressure annular cavities 41, 41*a*** which are relieved to atmosphere. The low pressure may be about atmospheric pressure while the high pressure is on the order of 100 psi gauge pressure or pressure above atmospheric pressure.

FIG. 1 shows an initial state with piston 13 in its first (leftmost) position and with the air control valve 15 latched closed. In this state, annular ring 29 of valve 15 is seated in an annular slot in the housing 19 and seals against an o-ring 31. This seals the pressure in cavity 39 and prevents the application of any moving force to the main piston 13. In this position, the main piston 13 is being urged to the left (latched) by the pressure in cavity or chamber 44a which is greater than the pressure in chamber or cavity **41*a* which, in FIG. 1., communicates with surface 14 of recessed body 32 through annular passage 16*a* axially parallel bores 22*a* in valve 15*a* and axially parallel bores or passages 51 in bodies 32, 32*a*, later described. Annular openings 16, 16*a* are formed when valves 15, 15*a* respectively are in their closed positions but close as valves 15, 15*a* move to their open positions. Recessed bodies 32, 32*a* are attached to and integral with piston 13. Shallow recesses or 'windows' 26, 26*a* and 34, 34*a* are formed respectively in bodies 32, 32*a*. In the leftmost position of piston 13 (FIG. 1), face 42 of piston 13 is exposed to low pressure cavity 41 through valve ports 33, bores 22 and opening 16**.

Figure 2:
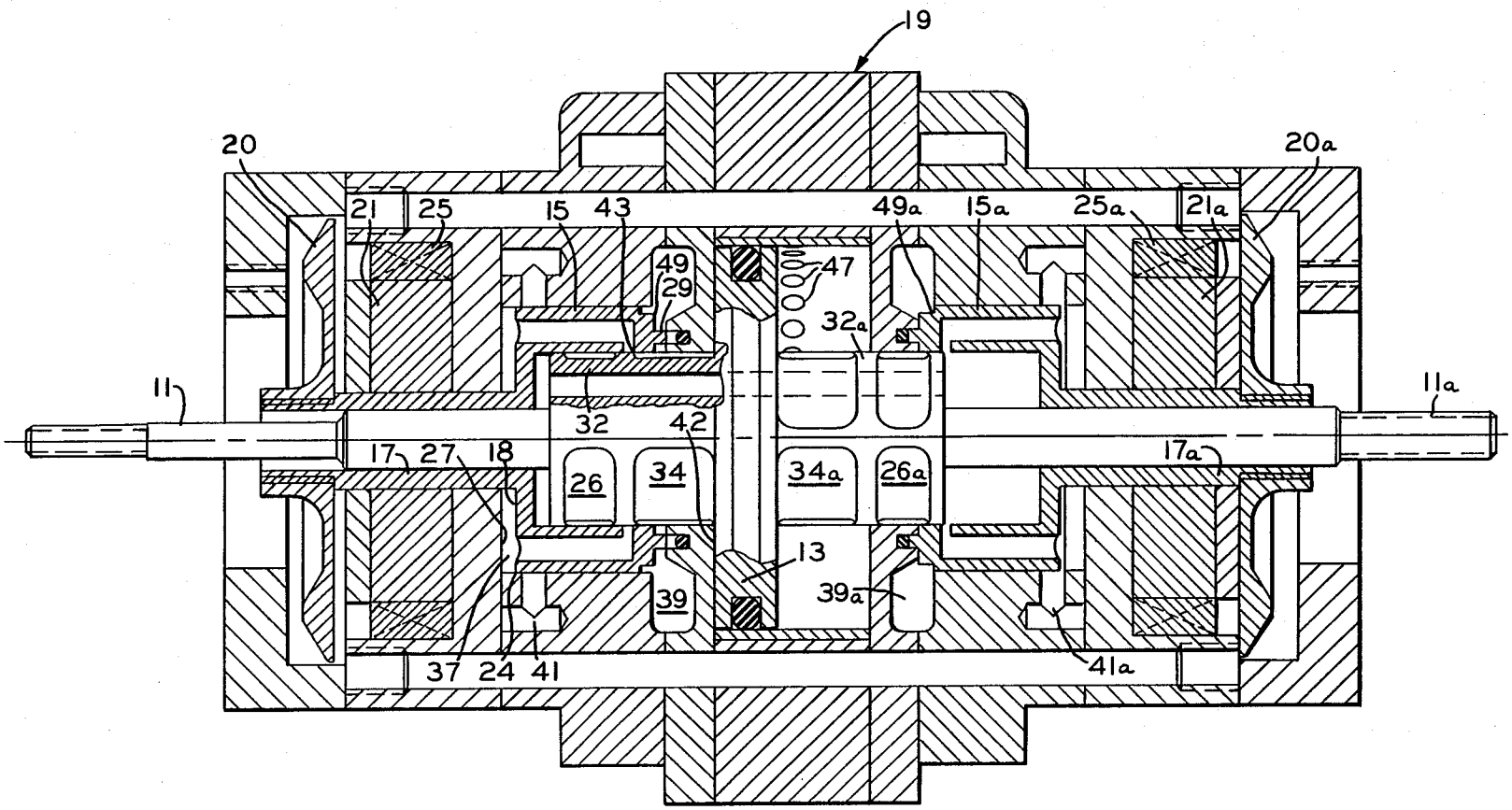
FIGS. 2–7 are views in cross-section similar to FIG. 1, but illustrating component motion and function as the piston progresses rightwardly to its extreme rightward or valve open position of a first embodiment of this invention.

In FIG. 2, the shuttle valve 15 has moved toward the left, for example, 0.060 in. while piston 13 has not yet moved and air at a high pressure now enters shallow recesses or 'windows' 34, of which there are four equally circumferentially spaced about body 32, from cavity 39 applying a motive force to the left face 42 of piston 13. The air valve 15 has opened because of an electrical pulse applied to coil 25 which has temporarily neutralized or weakened the holding force on iron armature or plate 20 by permanent magnet 21. Armature 20 is fixed to the end of valve shaft 17. When that holding force is temporarily neutralized, air pressure in cavity 39 which is applied to the air pressure responsive first annular face 49 of valve 15 causes the valve to open. Notice that the communication between cavity 37, formed between second annular surface 18 and housing wall 26, and the low pressure outlet port 41 has been interrupted by movement of the valve 15 leftwardly with annular shoulder 24 of valve 15 cutting off fluid communication between low pressure cavity 41 and chamber 37. During this movement, communication is being established between cavity 39 and face 42 across ring 20 of valve 15, to force piston 13 rightwardly.

It should be noted that ring 29 does not leave the annular slot in housing 19 until annular shoulder 43 of valve 15 engages the edges of recesses 34 to fully pressurize recesses 34 and cavity 44. (FIG. 3)

Figure 3:
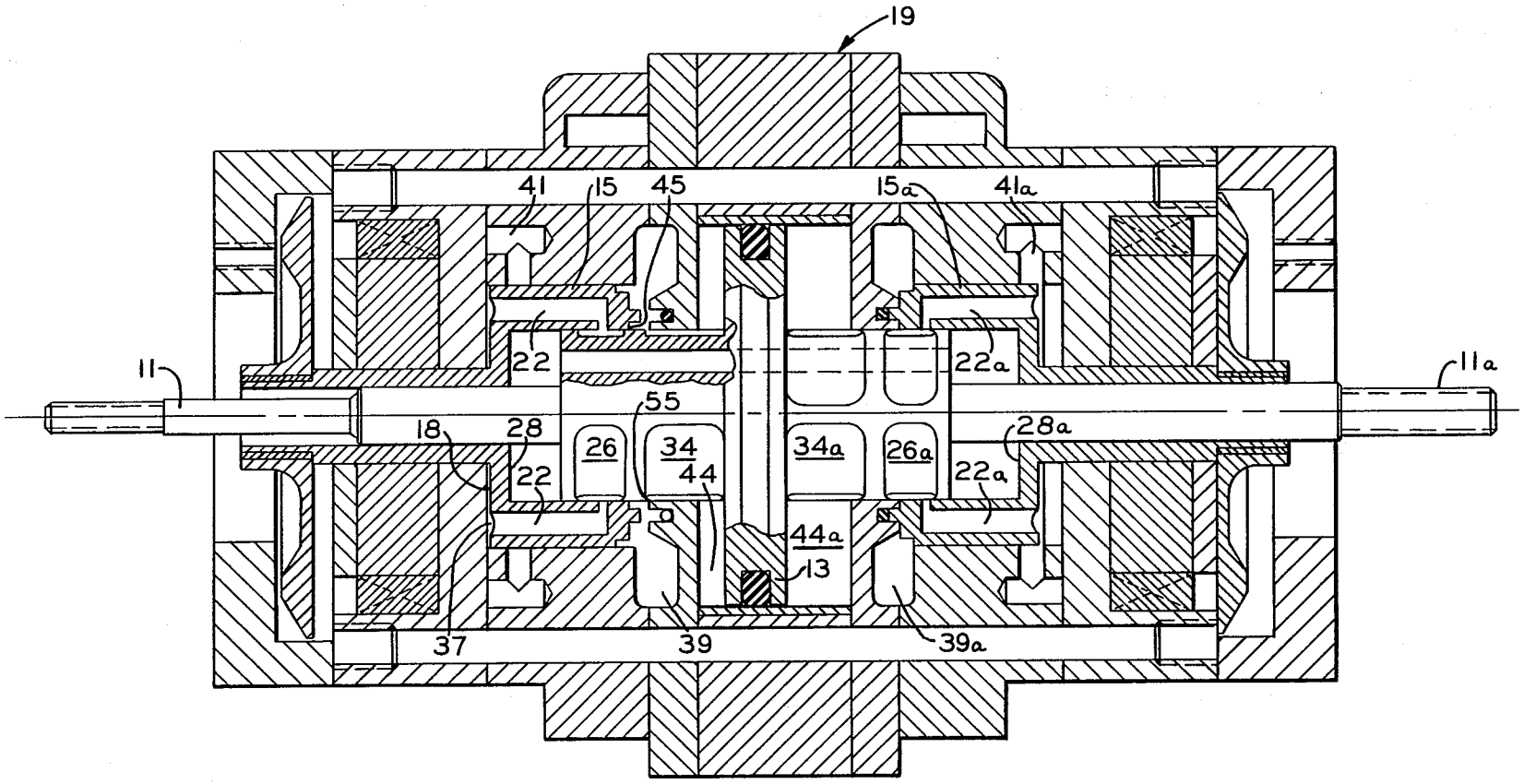

FIG. 3 shows the leftward movement or opening of the air valve 15 to about 0.110 in. (approximately wide open) and movement of the piston 13 about 0.140 in. to the right. In FIG. 2, the high pressure air had been supplied to the cavity 37 and to the face 42 of piston 13 driving the piston toward the right. That high pressure air supply to cavity 44 will be cut off as edges of recesses 34 pass the annular shoulder 55 of the housing 19. Piston 13 continues rightwardly, however, due to the existing high pressure air in cavity 44. There are a plurality of axially parallel bores 22 circumferentially spaced in valve 15. The relative axial movement between valve 15 and piston 13 has almost reached the point where annular shoulder 45 on valve 15 will open a fluid path between cavity 39 and chamber 37 through recesses 26 and bores 22 causing a high pressure on surface 18 and connected surfaces to provide a net closing (rightward movement) force on valve 15. Inner annular surfaces 28, 28*a* on valves 15, 15*a* respectively, are subject to low or atmospheric pressure throughout the cycle of piston and valve operation as will become apparent.

Figure 4:
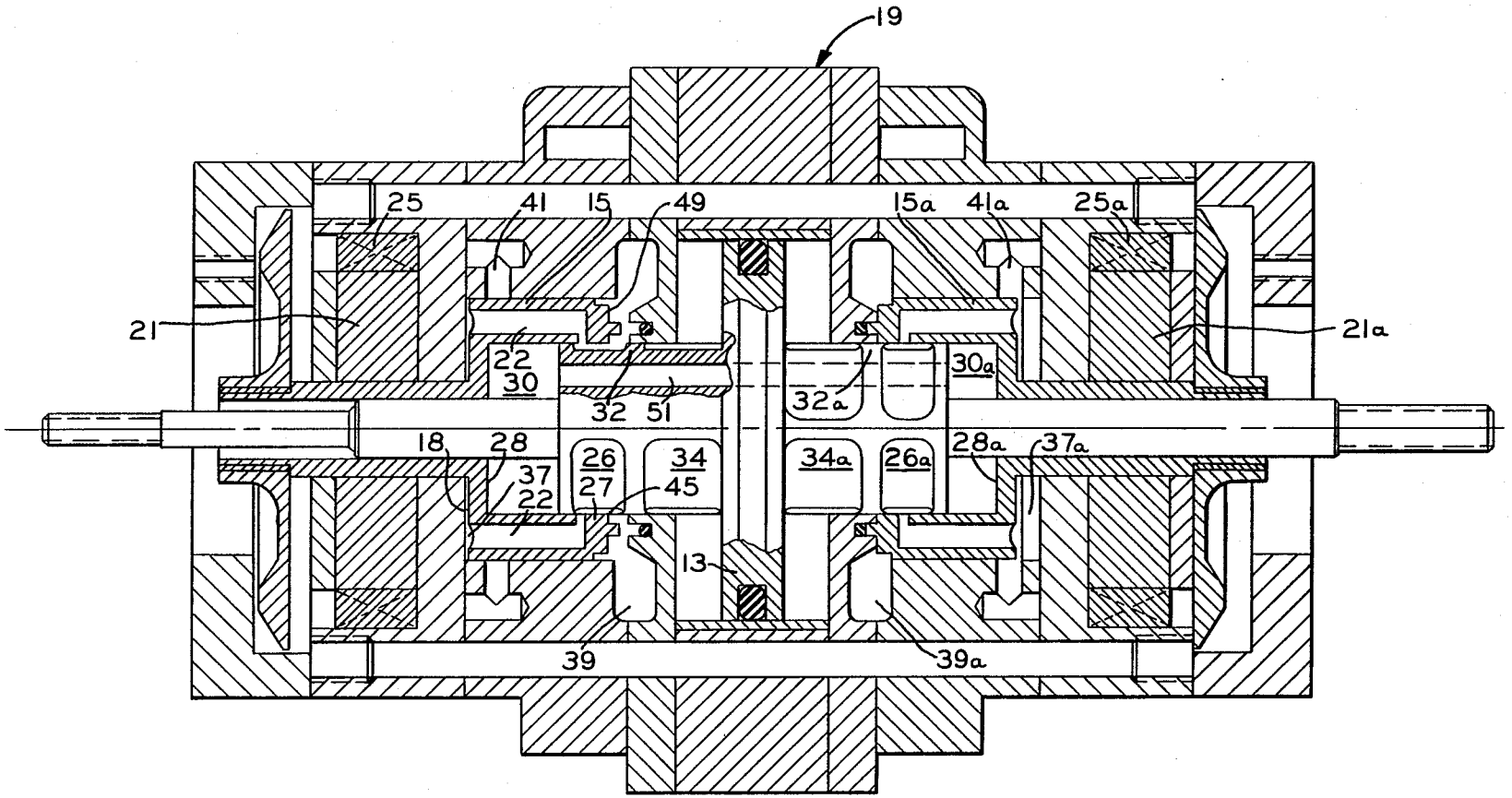

The piston 13 has moved approximately 0.240 inches and is continuing to move toward the right in FIG. 4 and the air valve 15 is still at 0.110 inches and has reached its maximum leftward open displacement. Shoulder 45 has fully cleared the associated edges of recesses 26 to introduce pressure from cavity 39 to chamber 37 around land 27 and apply high pressure to surface 18. The valve 15 will tend to remain in this position for a short time due to the continuing air pressure on the annular surface 49, and connected surfaces, from high pressure soucee 39. However, since surface 18 is greater in area than surface 49, valve 15 has a net pneumatic force in the closing (rightward) direction, greatly reducing the force required to return the air valve from its open (leftmost) position. Thus the magnetic force of permanent magnet 21 on armature 20 required to pull the air valve 15 back toward its closed position is greatly reduced. By venting the high pressure from source 39 through recesses 26, which are positioned aft of recesses 34, the pressure on surface 18 is delayed untll piston 13 is well advanced and there is no likelihood that valve 15 will prematurely close.

An important feature of this invention is the provision of axially parallel bores or passages 51 in bodies 32, 32*a* and piston 13. There are a number of passages 51 circumferentially spaced that equalize the pressure in chambers 30, 30*a* throughout cycling of valves 15, 15*a* and piston 13. This is true since at all times at least one of chambers 30, 30*a* is in fluid communication with a low pressure source 41, 41*a*. This is a very effective and efficient way of insuring that a low pressure will be on surfaces 28, 28*a* at all times so that when a high closing pressure is applied to chambers 37, 37*a* valves 15, 15*a*, respectively, will be efficiently closed under pneumatic force.

Figure 5:
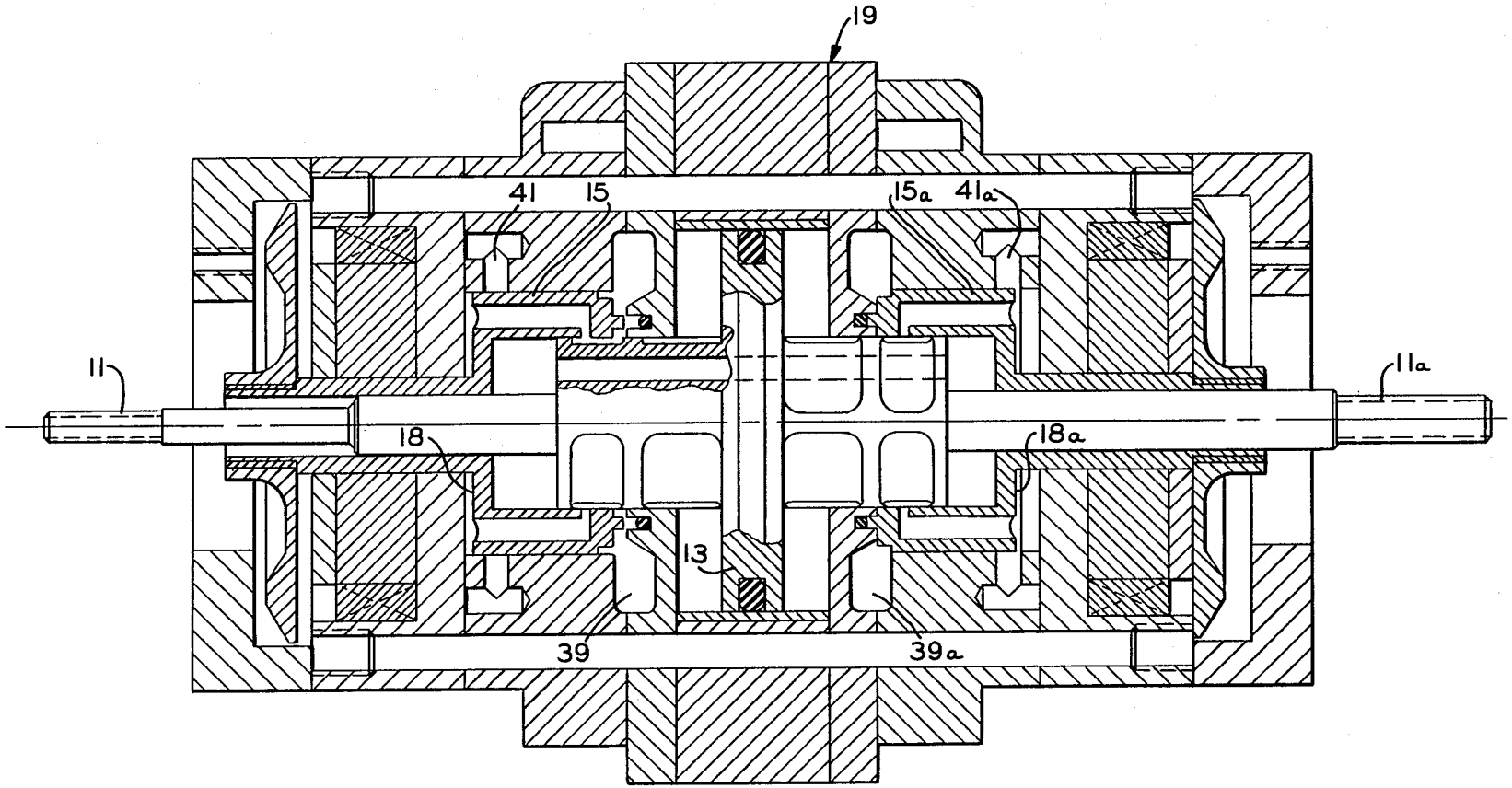
Figure 6:
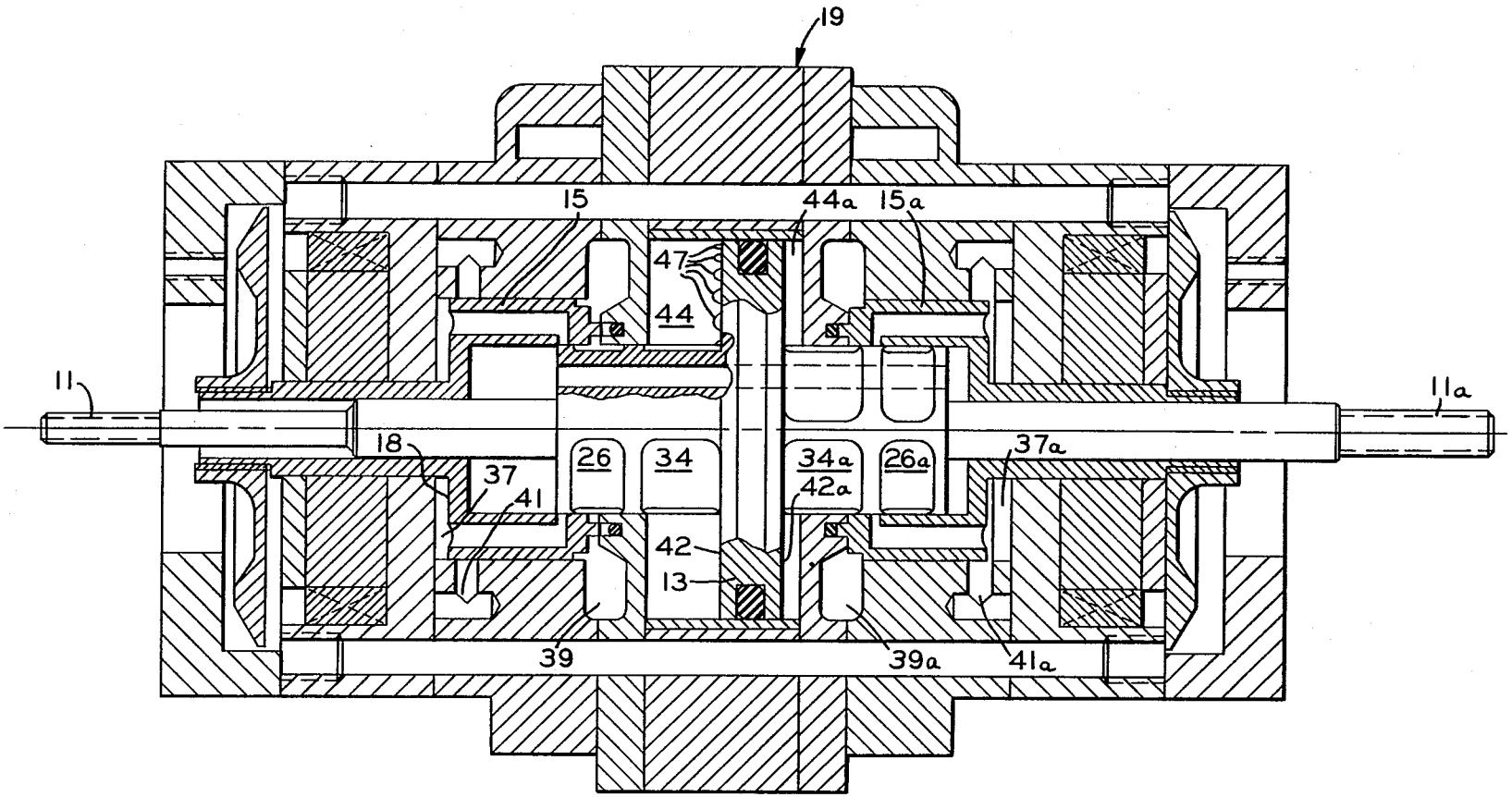

In FIG. 5, the air valve 15 is about 0.080 inches from its closed position and is returning to its closed position under the pneumatic force on surface 18 and the attractive force of magnet 21 on disk 20 is causing the disk to move back toward the magnetic latch. Piston 13 has moved about 0.240 inches in FIG. 5. In FIG. 6 valve 15 is about 0.060 inches from its closed position and piston 13 has traveled about 0.385 in.

An intermediate pressure, such as 4 psi gauge, is introduced from intermediate ports 47, which are supplied by a source not shown, into cavity 44 so that the high pressure air in chamber 44 is blown down to the intermediate pressure. This feature has also been disclosed in the above referenced application Ser. No. 153,155 which is incorporated by reference herein. Vents 47 dump expanded air from primary working surface 42 of piston 13 and remove the accelerating force from the piston. The vents 47 also function to introduce air at the intermediate pressure to be captured and compressed by the opposite primary working surface 42*a* of the piston to slow piston motion as it nears its second position and vents 47 supply intermediate pressure air to working surface 42 of the piston to temporarily hold the piston in its second position pending the next opening of air control valve 15*a*.

Figure 7:
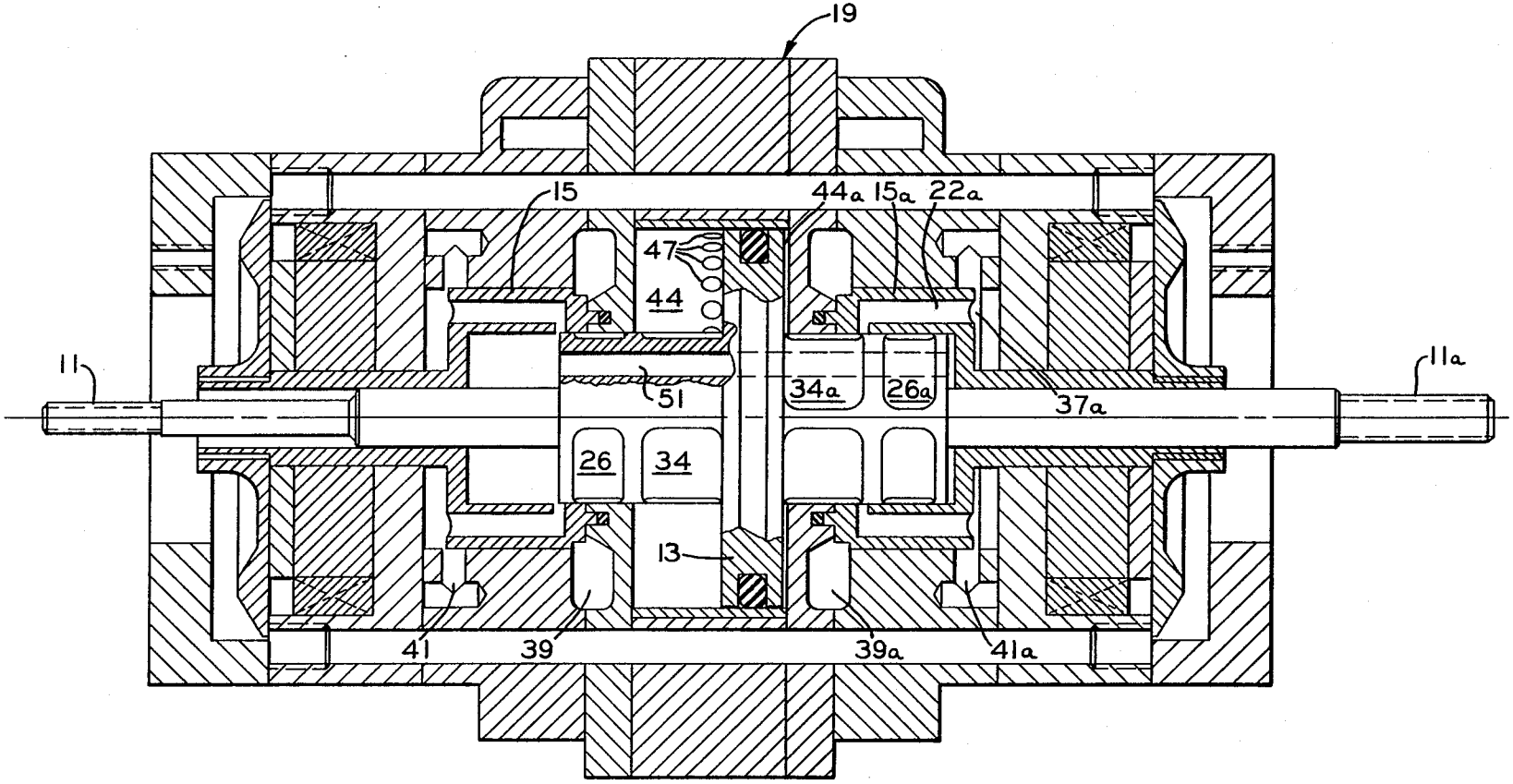

FIG. 7 illustrates air valves 15, 15*a* in their fully closed positions and piston 13 approaching its extreme rightward position, the highly pressurized air in chamber 44*a* being exhausted to atmosphere through recess 34*a*, bore 22*a*, cavity 37*a* and cavity 41*a*. Due to the aforementioned symmetry of valve construction, the movements of valve 15*a* and piston 13 in the return of piston 13 from its second (rightmost) position to its first (leftmost) position is the mirror of the previously described operation of valve 15 and piston 13.

It will be understood from the symmetry of the valve actuator that the behavior of the air control valves 15 and 15*a* in this venting or blow-down is, as are many of the other features, substantially the same near each of the opposite extremes of the piston travel. These same components cooperate at the beginning of a stroke to supply air to power the piston for a much longer portion of the stroke. It should be noted that at all stages of valve 15 cycling between open and closed positions, a high pressure is exerted on the outer annular face 49 and as will be understood by those in the art, this provides controlled play-free valve operation.

Figure 8:
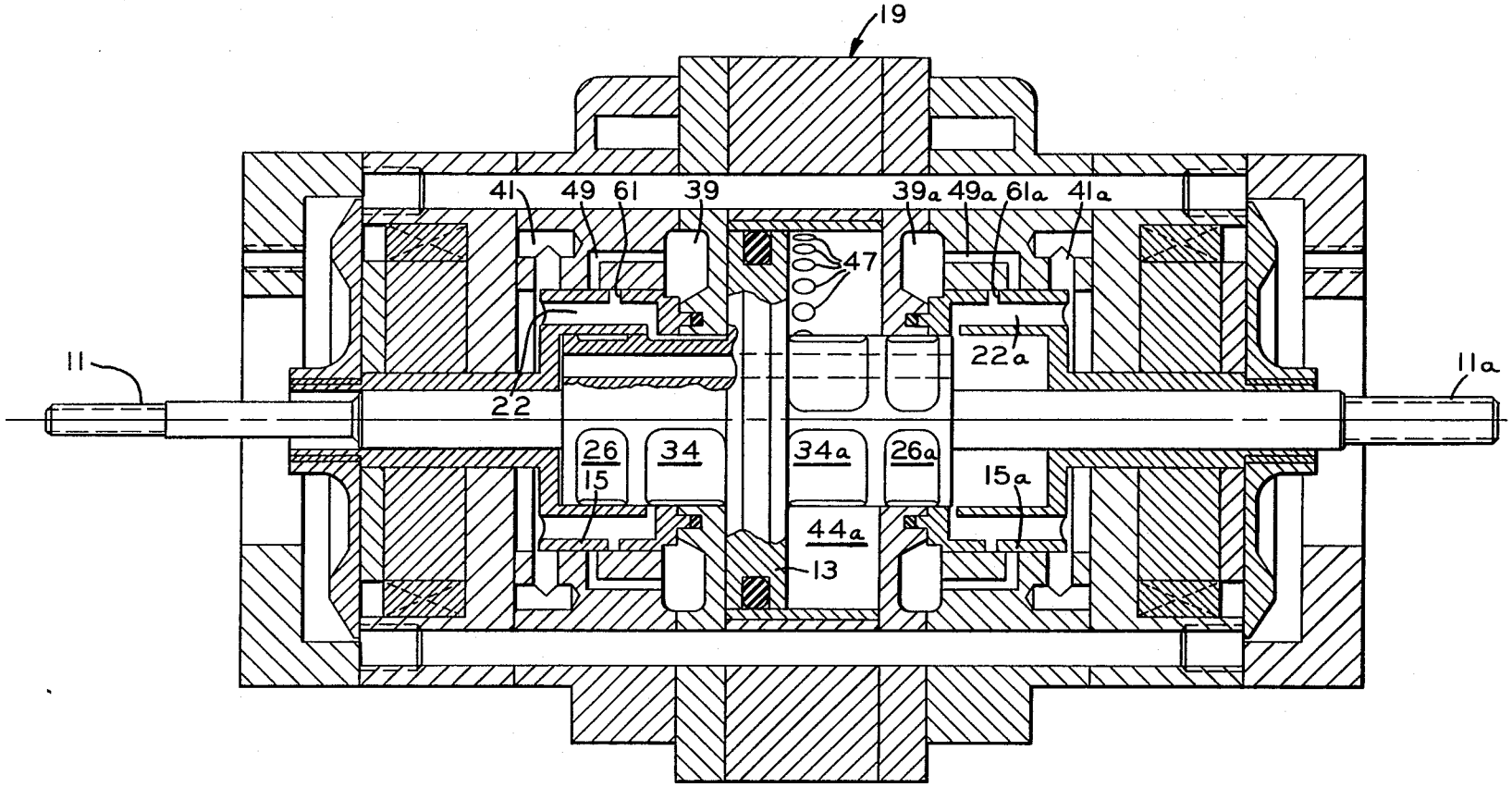
FIG. 8 is a view in cross section similar to FIGS. 2–8 and showing relative positions of the air valve and power piston of another embodiment of this invention.

FIG. 8 illustrates an embodiment of this invention which is similar in construction and operation to that in FIGS. 1–7 with the exception that high pressure air is introduced into bores 22, additionally through air tunnels 49, there being a tunnel 49 for each bore 22 and each tunnel 49 communicating with high pressure annular chamber 39. Also added in the FIG. 8 embodiment are ports 61 which are formed in valve 15, with a port 61 registering with a respective tunnel 49 upon a mid open position of valve 15, not shown. At that time high pressure air is introduced into chamber 37 from cavity 39 as in the embodiment of FIGS. 1–7 as well as through tunnels 59 ports 61 and bores 22.

Similarly, chamber 37*a* is provided with high pressure air by similar and symmetrical tunnels 49*a*, ports 61*a* and bores 22*a* at a corresponding time in operation of valve 15*a*.

It should be noted that in this embodiment, axial movement of valves 15, 15*a* relative housing 19, independently of piston 13 position, supplies high valve closing pressure to chambers 37, 37*a*.

Little has been said about the internal combustion engine environment in which this invention finds great utility. That environment may be much the same as disclosed in the abovementioned copending applications and the literature cited therein to which reference may be had for details of features such as electronic controls and air pressure sources. In this preferred environment, the mass of the actuating piston and its associated coupled engine valve is greatly reduced as compared to the prior devices. While the engine valve and piston move about 0.45 inches between fully open and fully closed positions, the control valves move only about 0.125 inches, therefor requiring less energy to operate. The air passageways in the present invention are generally large annular openings with little or no associated throttling losses.

From the foregoing, it is now apparent that a novel electronically controlled, pneumatically powered actuator has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. An electronically controlled fluid powered power valve actuator for use in an internal combustion engine of the type having engine intake and exhaust valves with elongated valve stems;

said actuator having a power piston having a piston driven side reciprocative along an axis between first and second positions in a housing corresponding to engine valve open and closed positions;

a control valve reciprocative along said axis between open and closed positions for controlling the pneumatic pressure from a pneumatic pressure source to said power piston to move said power piston and said member to said first and second positions;

latching means for closing and holding said control valve in its closed position;

pneumatic pressure control means comprising said source for providing pneumatic pressure to said valve to move said valve towards its open valve position against the holding force of said latching means;

said pressure control means for providing a net pneumatic pressure closing force to said valve after said piston has moved a predetermined distance towards its first position from its second position.

2. The apparatus of claim 1 wherein said latching means comprises a permanent magnet for providing a closing and latching force to hold said valve in a closed position and electromagnetic means to temporarily weaken said permanent magnet latching force;

said pressure control means for applying pneumatic pressure from said source to a first valve surface causing an opening force on said valve and a second valve surface causing a closing force on said valve; the net pneumatic opening force on said first valve surface in said closed position being less than said permanent magnet latching force but being greater than said permanent magnet latching force when temporarily weakened by said electromagnetic means thereby causing said valve to move in an opening direction to provide pneumatic pressure to said piston drive side to move said piston towards its first position.

3. The apparatus of claim 2 wherein said valve is axially movable and said first and second surfaces comprise first and second annular oppositely facing surfaces respectively on a tubular valve section adjacent one axial end of said valve;

said fluid pressure control means selectively applying a fluid pressure differential from said source across said annular surfaces as said latching force is weakened to move said valve in an opening direction to move said piston to its first position and to move said valve in a closing direction after said piston has reached said predetermined distance.

4. The apparatus of claim 3 wherein said fluid pressure control means applies a constant fluid pressure to a portion of one of said annular surfaces throughout a cycle of valve opening and closing movements to provide valve movement control throughout said cycle.

5. The apparatus of claims 3 wherein said pressure control means further comprises a cylindrical body affixed to said piston and extending through and axially movable relative to said tubular valve section;

said valve having port means for fluid communication between an inner surface of said valve section and said second annular surface;

said body having a first circumferential set of recessed surfaces registrable with said source and said port means to provide fluid communication and fluid pressure to said second annular surface for moving said valve in a closing direction;

said body having a second circumferential set of recessed surfaces axially spaced from said first set and registrable with said source and said driven surface for providing fluid pressure to said driven surface as said valve is opening.

6. The apparatus of claim 3 wherein said pressure control means further comprises a cylindrical body affixed to said piston and extending through and axially movable relative to said tubular valve section;

said valve having port means for fluid communication between said source and said second annular surface.

7. The apparatus of claim 6 including second port means in said valve for providing fluid communication between an inner surface of said valve section and said second annular surface;

said body has a first circumferential set of recessed surfaces registrable with said source and said second port means to provide fluid communication and fluid pressure to said second annular surface for moving said valve in a closing direction;

said body having a second circumferential set of recessed surfaces axially spaced from said first set and registrable with said source and said driven surface for providing fluid pressure to said driven surface as said valve is opening.

8. A pneumatically powered valve actuator comprising a valve actuator housing;

a piston reciprocative within the housing along an axis and having opposite driven sides;

said piston having a pair of oppositely facing primary working surfaces;

a pair of air control valves reciprocative along said axis relative to both the housing and the piston between open and closed positions;

latching means for closing and holding said valves in their respective closed positions;

pneumatic pressure control means comprising a pneumatic pressure source for providing pneumatic pressure to said valves to move said valves towards their respective open valve positions against the holding force of said latching means;

said pressure control means for providing a net pneumatic pressure closing force to one of said valves after said piston has moved a predetermined distance towards its first position from its second position and for providing a net pneumatic pressure closing force to the other of said valves after said piston has moved a predetermined distance towards its second position from its first position.

9. The apparatus of claim 8 wherein said pressure control means comprises chambers at each axial end of said piston travel and said chambers communicating with one surface of a respective one of said pair of valves;

said pressure control means providing substantially atmospheric pressure to at least one of said chambers throughout the piston travel cycle between said first and second positions;

equalization passages being formed in said piston for providing fluid communication between said chambers whereby said one surface of each valve is at substantially atmospheric pressure throughout the piston travel cycle between said first and second positions.

10. The apparatus of claim 8 wherein said latching means comprises permanent magnet means for providing a closing and latching force to hold said valves in a closed position and electromagnetic means to temporarily weaken said permanent magnet means latching force;

said pressure control means for applying pneumatic pressure from said source to a first valve surface of each valve causing an opening force on each of said valves and a second valve surface of said valve causing a closing force on each of said valves; the net pneumatic opening force on said first valve surface of each of said valves in said closed position being less than said permanent magnet means latching force but being greater than said permanent magnet means latching force when temporarily weakened by said electromagnetic means thereby causing said each of said valves to move in an opening direction to provide pneumatic pressure to a respective piston driven side to move said piston towards its first and second positions.

11. The apparatus of claim 10 wherein said valves are axially movable and said first and second surfaces comprise first and second annular oppositely facing surfaces respectively on a respective tubular valve section adjacent a respective axial valve end;

said fluid pressure control means selectively applying a fluid pressure differential from said source across said annular surfaces of each of said valves as said latching force is weakened to move said valves in an opening direction to move said piston to its respective first and second positions and to move said valves in a closing direction after said piston has reached said predetermined distance from its respective first and second positions.

12. The apparatus of claim 11 wherein said fluid pressure control means applies a constant fluid pressure to a portion of one of said annular surfaces of each of said valves throughout a cycle of valve opening and closing movements to provide valve movement control throughout said cycle.

13. The apparatus of claim 11 wherein said pressure control means comprises a cylindrical body affixed to either axial side of said piston; one cylindrical body extending through and axially movable relative to said tubular valve section of one valve and the other cylindrical body extending through and axially movable relative to the other said tubular valve section;

said valves each having port means for fluid communication between an inner surface of a respective said valve section and a respective said second annular surface;

each of said bodies having a first circumferential set of recessed surfaces registrable with said source and a respective said port means to provide fluid communication and fluid pressure to a respective said second annular surface for moving a respective said valve in a closing direction;

each of said bodies having a second circumferential set of recessed surfaces axially spaced from a respective said first set and registrable with said source and a respective said driven surface for providing fluid pressure to a respective said driven surface as a respective said valve is opening.

14. The apparatus of claim 11 wherein said pressure control means further comprises a cylindrical body affixed to either side of piston; said one cylindrical body extending through and axially movable relative to said tubular valve section of one valve and the other cylindrical body extending through and axially movable relative to the other tubular valve section;

each of said valves having port means for fluid communication between said source and a respective said second annular surface.

15. The apparatus of claim 14 including second port means in each of said valves for providing fluid communication between an inner surface of a respective said valve section and a respective said second annular surface;

each of said bodies having a first circumferential set of recessed surfaces registrable with said source and a respective said second port means to provide fluid communication and fluid pressure to a respective said second annular surface for moving a respective said valve in a closing direction;

each of said bodies having a second circumferential set of recessed surfaces axially spaced from a respective said first set and registrable with said source and a respective said driven surface for providing fluid pressure to a respective said driven surface as a respective said valve is opening.

16. A fluid powered transducer with a first member having a fluid pressure driven side reciprocative along an axis in a housing between first and second positions;

a control valve reciprocative in said housing between open and closed positions;

latching means for closing and holding said valve in its closed position;

fluid pressure control means comprising a fluid pressure source for providing fluid pressure to said valve to move said valve towards said open valve position against the holding force of said latching means;

said fluid pressure control means for providing a net fluid pressure closing force to said valve after said first member has moved a predetermined distance towards its first position.

17. The apparatus of claim 16 wherein said latching means comprises a permanent magnet for providing a closing and latching force to hold said valve in a closed position and electromagnetic means to temporarily weaken said permanent magnet latching force;

said fluid pressure control means for applying fluid pressure from said source to a first valve surface causing an opening force on said valve and a second valve surface causing a closing force on said valve; the net fluid opening force on said first valve surface in said closed position being less than said permanent magnet latching force but being greater than said permanent magnet latching force when temporarily weakened by said electromagnetic means thereby causing said valve to move in an opening direction to provide fluid pressure to said member driven side to move said member towards its first position.

18. The apparatus of claim 17 wherein said valve is axially movable and said first and second surfaces comprise first and second annular oppositively facing surfaces respectively on a tubular valve section adjacent one axial end of said valve;

said fluid pressure control means selectively applying a fluid pressure differential from said source across said annular surfaces as said latching force is weakened to move said valve in an opening direction to move said member to its first position and to move said valve in a closing direction after said member has reached said predetermined distance.

19. The apparatus of claim 18 wherein said fluid pressure control means applies a constant fluid pressure to a portion of one of said annular surfaces throughout a cycle of valve opening and closing movements to provide valve movement control throughout said cycle.

20. The apparatus of claims 18 wherein said pressure control means further comprises a cylindrical body affixed to said first member and extending through and axially movable relative to said tubular valve section;

said valve having port means for fluid communication between an inner surface of said valve section and said second annular surface;

said body having a first circumferential set of recessed surfaces registrable with said source and said port means to provide fluid communication and fluid pressure to said second annular surface for moving said valve in a closing direction;

said body having a second circumferential set of recessed surfaces axially spaced from said first set and registrable with said source and said driven surface for providing fluid pressure to said member driven surface as said valve is opening.

21. The apparatus of claim 18 wherein said pressure control means further comprises a cylindrical body affixed to said first member and extending through and axially movable relative to said tubular valve section;

said valve housing port means for fluid communication between said source and said second annular surface.

22. The apparatus of claim 21 including second port means in said valve for providing fluid communication between an inner surface of said valve section and said second annular surface;

said body has a first circumferential set of recessed surfaces registrable with said source and said second port means to provide fluid communication and fluid pressure to said second annular surface for moving said valve in a closing direction;

said body having a second circumferential set of recessed surfaces axially spaced from said first set and registrable with said source and said driven surface for providing fluid pressure to said member driven surface as said valve is opening.

23. A fluid powered transducer with a first member having a fluid pressure driven side reciprocative along an axis in a housing between first and second positions;

a pair of control valves reciprocative in said housing between open and closed positions;

latching means for closing and holding said valves in their respective closed positions;

fluid pressure control means comprising a fluid pressure source for providing fluid pressure to said valves to move said valves towards their respective open valve positions against the holding force of said latching means;

said fluid pressure control means for providing a net fluid pressure closing force to one of said valves after said first member has moved a predetermined distance towards its first position from its second position and for providing a net fluid pressure closing force to the other of said valves after said first member has moved a predetermined distance towards its second position from its first position.

24. The apparatus of claim 23 wherein said fluid pressure control means comprises chambers at each axial end of said member travel and said chambers communicating with one surface of a respective one of said pair of valves;

said fluid pressure control means providing substantially atmospheric pressure to at least one of said chambers throughout the member travel cycle between said first and second positions;

equalization passages being formed in said member for providing fluid communication between said chambers whereby said one surface of each valve is at substantially atmospheric pressure throughout the member travel cycle between said first and second positions.

* * * * *

UNITED STATES PATENT AND TRADEMARK OFFICE

CERTIFICATE OF CORRECTION

PATENT NO. : 4,872,425

DATED : October 10, 1989

INVENTOR(S) : William E. Richeson and Frederick L. Erickson

It is certified that error appears in the above-identified patent and that said Letters Patent is hereby corrected as shown below:

Claim 3, column 10, line 6, cancel "fluid".

Claim 4, column 10, line 13, cancel "fluid".

Claim 8, column 10, line 59, cancel "and having opposite driven sides".

Claim 16, column 12, line 52, cancel "side" and substitute --surface--.

Claim 21, column 14, line 3, cancel "housing" and substitute --having--.

Claim 23, column 14, line 21, cancel "side" and substitute --surface--.

Signed and Sealed this

Fifteenth Day of October, 1991

*Attest:*

*Attesting Officer*

HARRY F. MANBECK, JR.

*Commissioner of Patents and Trademarks*